US006481950B1

(12) United States Patent
Stickney et al.

(10) Patent No.: US 6,481,950 B1
(45) Date of Patent: Nov. 19, 2002

(54) CONTROL LEVER ASSEMBLY

(75) Inventors: Douglas Brian Stickney, Dubuque; Ryan Matthew Lutze, Manchester, both of IA (US)

(73) Assignee: Deere & Company, Moline, IL (US)

( * ) Notice: Subject to any disclaimer, the term of this patent is extended or adjusted under 35 U.S.C. 154(b) by 148 days.

(21) Appl. No.: 09/676,843

(22) Filed: Sep. 29, 2000

(51) Int. Cl.[7] ..... G05G 9/047

(52) U.S. Cl. ..... 414/694; 74/471 XY; 74/491; 384/42

(58) Field of Search ..... 414/694, 685, 414/680; 74/471 XY, 491; 384/42

(56) References Cited

U.S. PATENT DOCUMENTS 3,091,130 A * 5/1963 Payerle et al. ..... 74/471 XY
5,110,253 A 5/1992 Ernst et al. ..... 414/694
5,544,990 A * 8/1996 Hardesty ..... 384/42 X
5,647,247 A * 7/1997 Magrini ..... 74/471 XY

OTHER PUBLICATIONS

Deere & Company Operator's Manual entitled "410D and 510D Backhoe Loader", OMT143669 Issue A2, pp. 35–1 thru 35–5, published in the U.S.A., 1992.

* cited by examiner

*Primary Examiner*—Donald W. Underwood

(57) ABSTRACT

A control lever for a work vehicle having a work implement is provided with a shaft that operates a control linkage. The shaft and control linkage control two functions of the work implement by manipulating two hydraulic control valves. The shaft can be moved in two orthogonal directions or arcs. To prevent cross talk between the control functions the control lever is prevented from twisting by a stub shaft that is received in an elongated slot. The side walls of the elongated slot restrain the twisting movement of the control lever. The elongated slot is provided with a U-shaped slider made of an anti-friction material such as slippery urethane plastic. The U-shaped slider has legs that conform to the side walls of the elongated slot. That portion of the stub shaft located in the elongated slot has a cylindrical configuration.

7 Claims, 3 Drawing Sheets

CONTROL LEVER ASSEMBLY

BACKGROUND OF THE INVENTION

1. Field of the Invention

The present invention is directed to using a U-shaped slider assembly formed of slippery urethane plastic for engaging a cylindrical stub shaft of a control linkage.

2. Description of the Prior Art

In operating a work vehicle, such as a loader backhoe, the operator controls a plurality of work operations through manipulating various control levers that control the positioning of hydraulic control valves. The hydraulic control valves in turn regulate the flow of hydraulic fluid to hydraulic cylinders that manipulate the work implement. When operating the backhoe the operator turns his seat to face rearwardly. The operator uses control levers to manipulate the boom relative to the tractor, the dipperstick relative to the boom and the bucket relative to the dipperstick.

On some loader backhoes the operator controls the backhoe by operating two control levers. In this control configuration, fore-and-aft movement of the left hand control lever lowers and raises the boom. Side-to-side movement of the left hand control lever moves the boom side-to-side. Fore-and-aft movement of the right hand control lever pivots the dipperstick relative to the boom. Side-to-side movement of the right hand control lever curls and uncurls the bucket relative to the dipperstick.

The control levers extend upwardly through a control console located in the rear of the operators cab. The control levers are operatively coupled to a control linkage that manipulates hydraulic control valves in response to movement of the control lever. In the above described control configuration, each control lever controls two hydraulic control valves. Each hydraulic control lever controls one backhoe function by extending and retracting the appropriate hydraulic cylinder or cylinders. To prevent cross talk between the functions, it is necessary to prevent the operator from twisting the control lever. To that end the control linkages have been provided with elongated slots in which a stub shaft is provided. The elongated slots have side walls that restraining the twisting motion of the control lever. To provide smooth operation, cylindrical bushings formed of anti-friction material such as ultra high molecular weight polyethylene are mounted to the stub shaft and contact the side walls of the elongated slot. The side walls of the elongated slot have sharp edges that can cut and damage the anti-friction bushings.

The control console is provided with control apertures through which the control levers pass. These apertures are larger than the diameter of the control lever to allow for pivotal movement of the control lever. The control aperture may be covered by a rubber boot that engages the control lever and the edge of the control aperture. In another application steel discs can be welded to the control levers. These discs are designed to be located below the control apertures. However they are not in contact with the interior wall of the console and dust and debris may fall onto the control linkages.

SUMMARY

A control lever for a work vehicle having a work implement is provided with a vertically extending shaft that operates a control linkage. The control linkage defines a horizontal control plane that is substantially perpendicular to the shaft. The shaft and control linkage control two functions of the work implement by manipulating two hydraulic control valves. The shaft can be moved in two orthogonal directions or arcs. To prevent cross talk between the control functions the control lever is prevented from twisting by a stub shaft that is received in an elongated slot. The side walls of the elongated slot restrain the twisting movement of the control lever. The elongated slot is provided with a U-shaped slider made of an anti-friction material such as slippery urethane plastic. The U-shaped slider has legs that conform to the side walls of the elongated slot. That portion of the stub shaft located in the elongated slot has a cylindrical configuration.

DETAILED DESCRIPTION

Figure 1:
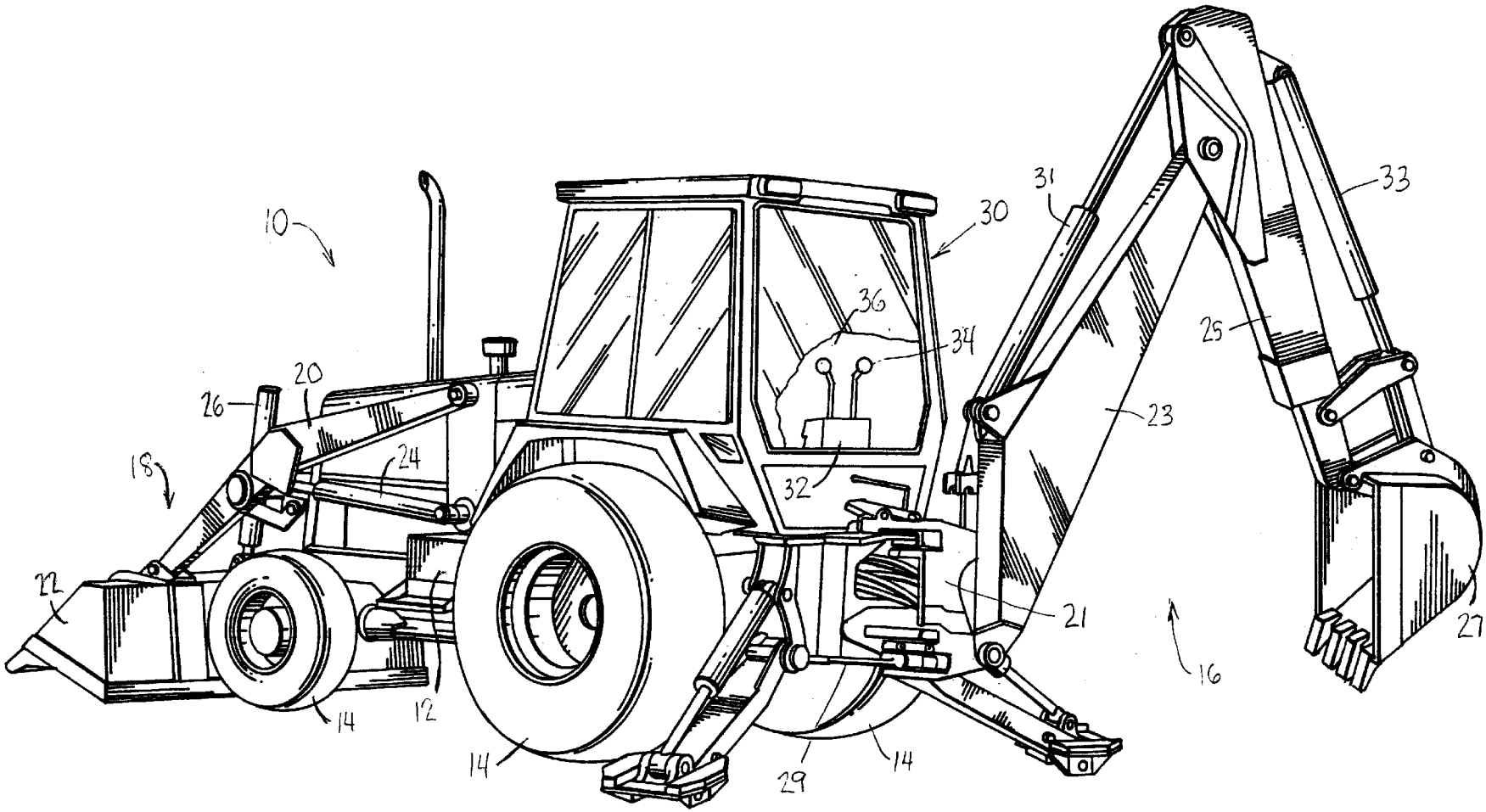
FIG. 1 is a rear perspective view of a loader backhoe having a cutaway rear window.
Figure 2:
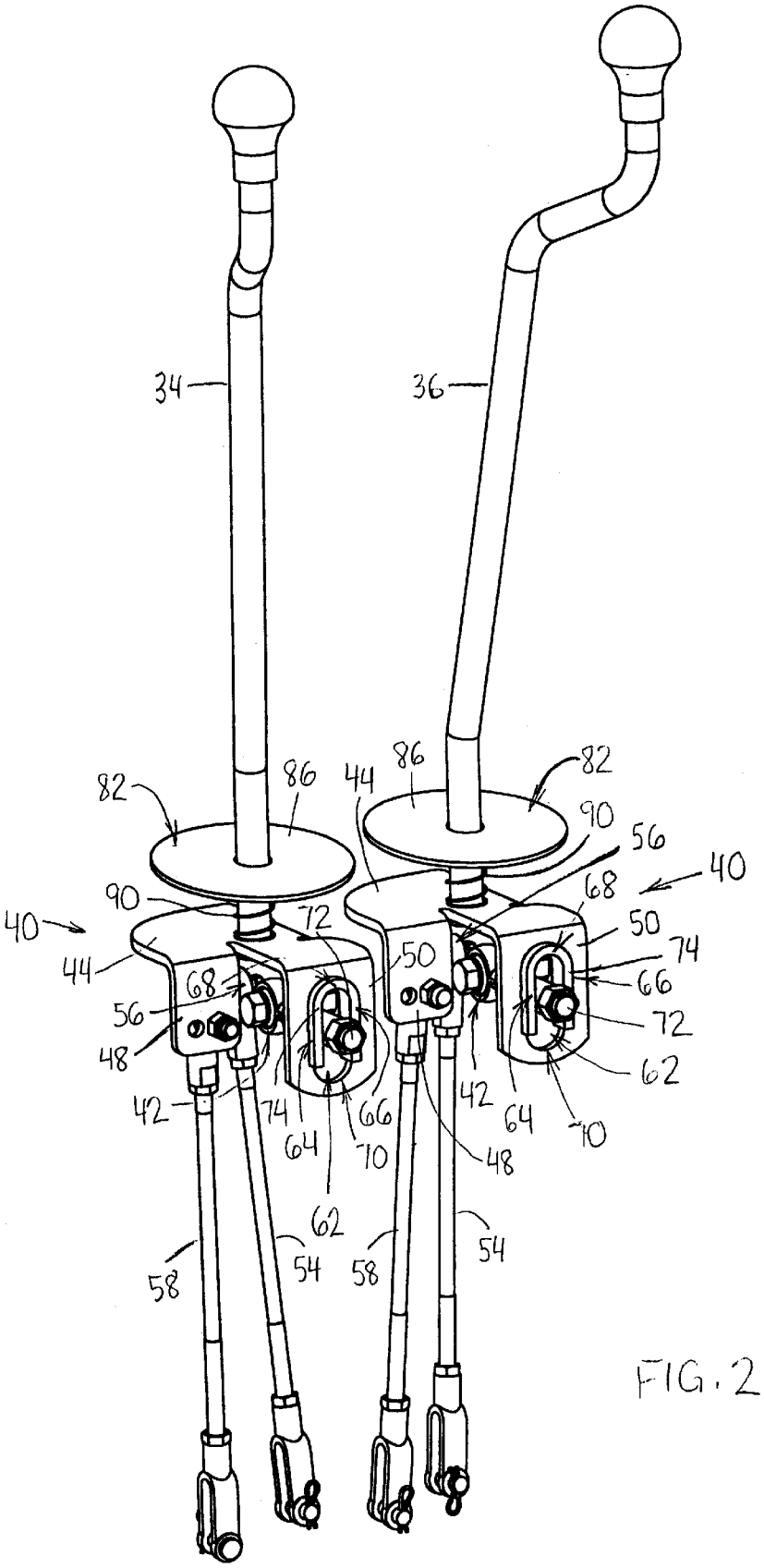
FIG. 2 is a perspective view of the control mechanism including control levers and the control linkage.
Figure 3:
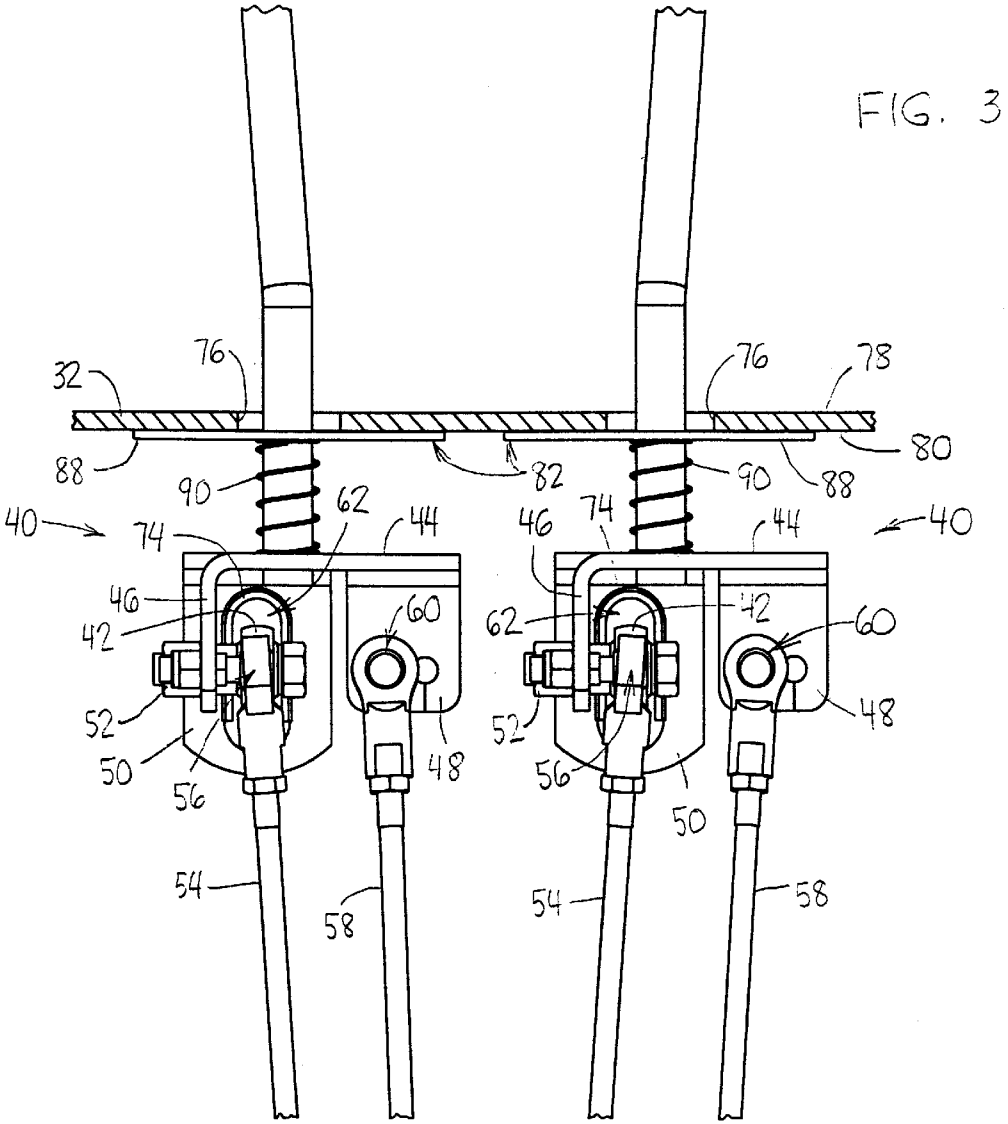
FIG. 3 is a side view of the control mechanism including the control levers and the control linkages.

The work vehicle 10 illustrated in FIG. 1 is a loader backhoe. The work vehicle 10 is provided with a supporting structure 12 and ground engaging means 14 comprising wheels which support and propel the supporting structure 12. Although the ground engaging means 14 of the illustrated embodiment are wheels, the present invention could also be used on tracked work vehicles having steel or rubber tracks. The supporting structure 12 is provided with two work implements, a backhoe 16 and a loader 18.

The loader is mounted to the front of the supporting structure 12 and comprises lift arms 20, only one shown, and a bucket 22. The lift arms 20 are provided with lift arm hydraulic cylinders 24, only one shown, for lifting the arms 20 relative to the supporting structure 12. The bucket 22 is pivotally mounted to the end of the lift arms 20. Bucket 22 is provided with a bucket-tilt hydraulic cylinder 26 for tilting the bucket 22 relative to the lift arms 20.

The backhoe 16 is mounted to the rear of the supporting structure 12 and comprises a swing frame 21, a boom 23, a dipperstick 25 and a bucket 27. The swing frame 21 is pivotally mounted to the supporting structure 12 about a vertical pivot axis. Swing frame hydraulic cylinders 29 swing the swing frame 21. The boom 23 is pivotally coupled to the swing frame about a horizontal pivot and is raised and lowered by a hydraulic cylinder internally mounted in the boom 23. The dipperstick 25 is pivotally mounted to the boom about a horizontal axis and is pivoted relative to the boom by dipperstick hydraulic cylinder 31. The bucket 27 is curled and uncurled relative to the dipperstick by bucket hydraulic cylinder 33.

Hydraulic control valves control the extension and retraction of the hydraulic cylinders. The hydraulic control valves are opened and closed by a mechanical control mechanism comprising control levers and control linkage located inside operators cab 30. A control console 32 is located in the operators cab. The control console 32 is provided with two control levers 34 and 36 extending upwardly from the console 32. The left hand control lever 34 controls the positioning of the boom 23. The right hand control lever 36 controls the positioning of the dipperstick 25 and bucket 27.

Each control lever 34 and 36 controls two functions by selectively positioning two hydraulic control valves. The control levers 34 and 36 can be moved in two orthogonal directions or control arcs, fore-and-aft and side-to-side. For example, moving the left-hand control lever 34 fore-and-aft lowers and raises the boom 23 by extending and retracting the internally mounted hydraulic cylinder. Moving left-hand control lever 34 side-to-side pivots the swing frame 21 by extending and retracting swing frame hydraulic cylinders 29.

The control levers 34 and 36 extend upwardly from hydraulic control linkage 40. The linkage 40 comprises a ball joint 42 that is mounted to the supporting structure 12 of the work vehicle 10. A shelf extending outwardly from the supporting structure 12 is provided with a vertical post on which the ball joint 42 is mounted. Plates 44 each having three downwardly depending tangs 46, 48 and 50 are welded to the bases of the control levers 34 and 36. Tang 46 of the plate 44 is pivotally mounted to the ball joint 42 by bolts 52. Tang 46 is also provided with a downwardly extending control link 54 for controlling a hydraulic control valve. The control link 54 is coupled to the tang 46 by a ball joint 56. Similarly, tang 48 is coupled to a downwardly extending control link 58 having a ball joint 60 for controlling another hydraulic control valve. Fore-and-aft movement of control levers 34 and 36 manipulates control links 54, whereas side-to-side movement of control levers 34 and 36 manipulates control links 58. The three ball joints 42, 56 and 60 define a control plane that is substantially perpendicular to the control levers 34 and 36.

Each of the control levers 34 and 36 control two hydraulic control valves, which in turn control two loader functions. Therefore it is necessary to restrain the twisting movement of the control lever. To that end, tang 50 of the plate 44 is provided with an elongated slot 62. This oblong slot 62 is provided with two side walls 64 and 66. A concave top 68 and a concave bottom 70 link the side walls 64 and 66 to one another. The ball joint has a laterally extending stub shaft 72 that extends into this slot 62. If an operator attempts to twist the control levers 34 and 36 the cylindrical stub shaft 72 comes into contact with the side walls 64 and 66 which restrain this movement. The side walls 64 and 66 are provided with a slider 74 formed of an anti-friction material in the form of a slippery urethane plastic. The slider 74 is of a one-piece construction preformed into a U-shape. The slider 74 has a concave top for engaging the concave top 68 of the elongated slot 62 and legs for engaging the side walls 64 and 66. The slider 74 is provided with a channel that grips the side walls 64 and 66 and the concave top 68 of the elongated slot 62. In addition the slider 74 is further held in place by the cylindrical stub shaft 72. With this design only a cylindrical surface, the cylindrical stub shaft 72, comes into contact with the anti-friction slider 74 thereby preventing premature wear of the slider 74 by eliminating sharp edge contact with the anti-friction material.

The control levers 34 and 36 extend upwardly through control apertures 76 in the control console 32. The control apertures 76 are circular and sized to permit pivoting movement of the respective control levers 34 and 36. The control console 32 has an exterior surface 78 and an interior surface 80. A rigid circular plastic disc 82 having a central opening 84 is slidably mounted on the control levers 34 and 36. The rigid disc 82 has a top side 86 and a bottom side 88. The bottom side 88 is provided with a coil spring 90. The coiled spring 90 defines an internal cylinder that is aligned with the central opening 84 and through which the control levers 34 and 36 extend. The coiled springs 90 extend between the plates 44 of the control linkages 40 and the discs 82.

The control console 32 is placed over the control levers 34 and 36 by letting the control levers pass through the respective control apertures 76. When the interior surface 80 of the control console 32 comes into contact with the top side 86 of the rigid disc 82 the coiled spring 90 is compressed downwardly. The rigid disc 82 forms a seal with the interior surface 80 of the control console 32. The rigid discs 82 are sized so that the control apertures 76 are sealed by the discs 82 even when the control levers 34 and 36 have been fully pivoted. The rigid discs 82 and coiled springs 90 provide a simple cover that is self sealing with the console and also free floating to conform to the console.

The present invention should not be limited by the above described embodiments, but should be limited solely by the claims that follow.

We claim:

1. A control lever for controlling the operation of a work implement, the control lever comprising:

a shaft extending substantially in a first direction that is generally perpendicular to a control plane;

a linkage is operatively coupled to the shaft for allowing the pivotal movement of the shaft in two orthogonal directions in the control plane, the linkage is provided with a stub shaft that is located in an elongated slot which prevents the twisting motion of the shaft, the elongated slot having elongated side walls, the elongated slot is oblong with the side walls being joined together by a concave shaped top wall and a concave shaped bottom wall;

a friction reducing material is attached to the side walls and the concave shaped top wall of the elongated slot, the stub shaft is cylindrical where it engages the friction reducing material on the side walls of the elongated slot, the friction reducing material is formed into a U-shaped insert that covers the side walls and the concave shaped top wall of the elongated slot.

2. A control lever as defined by claim 1 wherein the U-shaped insert is formed from a slippery urethane plastic.

3. A control lever as defined by claim 2 wherein movement of the shaft in two orthogonal directions manipulates hydraulic control valves for controlling the operation of the work implement.

4. A control lever as defined by claim 3 wherein the first direction is substantially vertical and the control plane is substantially horizontal.

5. A work vehicle for performing a work operation, the work vehicle comprising:

a supporting structure;

ground engaging means for propelling the work vehicle;

a work implement for performing a work operation is mounted to the supporting structure;

a control lever controls a first and a second function of the work operation of the work implement, the control lever is provided with a shaft extending generally vertically from a horizontal control plane, a linkage is operatively coupled to the shaft for allowing pivotal movement of the shaft in two orthogonal directions in the control plane, the linkage is provided with a stub shaft that is located in an elongated slot having elongated side walls, the elongated slot is oblong with the side walls being joined together by a concave shaped top wall and a concave shaped bottom wall, and a slider formed of friction reducing material is attached to the side walls and the concave shaped top wall of the elongated slot, the stub shaft is cylindrical where it engages the slider, wherein the friction reducing material is formed into a U-shaped insert that covers the side walls and the concave shaped top wall of the elongated slot.

6. A work vehicle as defined by claim 5 wherein the U-shaped insert is formed from a slippery urethane plastic.

7. A work vehicle as defined by claim 6 wherein movement of the shaft in two orthogonal directions manipulates hydraulic control valves for controlling the operation of the work implement.

* * * * *